United States Patent [19]

Alexander

[11] Patent Number: 4,496,808

[45] Date of Patent: Jan. 29, 1985

[54] ELECTRICAL SWITCH MECHANISM

[75] Inventor: Warren R. Alexander, Pittsford, N.Y.

[73] Assignee: General Signal Corporation, Stamford, Conn.

[21] Appl. No.: 454,126

[22] Filed: Dec. 29, 1982

[51] Int. Cl.[3] ..... H01H 35/02

[52] U.S. Cl. ..... 200/61.45 R; 335/224; 200/153 A

[58] Field of Search ..... 200/61.45 M, 61.45 R, 200/61.48, 61.52, 61.46, 153 T, 153 LB, 153 N, 200/83 S, 83 SA, 153 A; 335/224, 225, 226; 73/492, 73/514, 515, 516 R, 517 R; 33/398, 400

[56] References Cited

U.S. PATENT DOCUMENTS

| | | | |
|---|---|---|---|
| Re. 16,810 | 12/1927 | Thurston | 200/153 LB |
| 1,934,526 | 11/1933 | Deuser | 335/225 |
| 2,152,256 | 3/1939 | Hewitt | 200/61.48 |
| 2,203,061 | 6/1940 | Schmettow | 200/61.48 |
| 2,650,961 | 9/1953 | Weaver | 200/61.48 |
| 2,658,120 | 11/1953 | Murphy | 200/83 S |
| 2,816,188 | 12/1957 | Stout | 200/61.45 R |
| 3,493,905 | 2/1970 | Foulke | 335/225 |
| 3,886,339 | 5/1975 | Jubenville | 200/61.45 M |
| 3,931,911 | 1/1976 | Kohl | 200/153 T |
| 4,295,020 | 10/1981 | Heydweiller | 200/61.45 R |

FOREIGN PATENT DOCUMENTS

| | | | |
|---|---|---|---|
| 382285 | 9/1964 | Switzerland | 335/225 |

*Primary Examiner*—E. A. Goldberg
*Assistant Examiner*—M. Reinhart
*Attorney, Agent, or Firm*—Milton E. Kleinman; Martin LuKacher

[57] ABSTRACT

An electrical switch mechanism which operates in response to deceleration or acceleration for use on board trains for brake assurance purposes. High sensitivity to deceleration or acceleration with low hysteresis is obtained by actuating a switch, when a pendulum swings a predetermined distance, through a force transfer system providing a mechanical advantage enabling a pendulum of reasonable size and mass to actuate commercially available switches which require appreciable actuating force. The motion of the pendulum is damped by an eddy current damper having a plurality of magnets establishing a magnetic field which alternates in direction along the path traversed by a vane of conductive material carried by the pendulum to reduce overswing in response to acceleration or deceleration, to reduce pendulum response to high frequency components of the acceleration and deceleration and help in preventing transient motion of the pendulum which might arise from other than deceleration or acceleration events which are to be detected by the switch mechanism.

11 Claims, 4 Drawing Figures

ELECTRICAL SWITCH MECHANISM

DESCRIPTION

The present invention relates to electrical switch mechanisms, and particularly to switch mechanisms which are responsive to acceleration and/or deceleration.

The invention is especially suitable for use in vehicle control systems for sensing deceleration and/or acceleration of a vehicle which exceeds predetermined levels. The vehicle may be a railway vehicle or train having an on board speed control system which is automatically operable in response to control signals; for example, a computer controlled subway train. The invention may be used in such systems as a brake assurance device so as to detect whether the train is decelerating at a predetermined deceleration after occurrence of a control signal commanding the train to stop. If the requisite deceleration is not detected, and, for example, the switch is not closed, such condition may be used to effect emergency brake application.

In U.S. Pat. No. 4,295,020, issued Oct. 13, 1981, an electrical switch mechanism is described which is especially adapted for use on board trains for brake assurance purposes. It is the principal object of the present invention to provide an improved electrical switch mechanism of the type described in this patent, which improved switch mechanism has greater sensitivity to changes in the rate of acceleration or deceleration as well as reduced hysteresis. For example, it is desired to detect a change in acceleration or deceleration of 1/10 mile per hour per second and cause the switch to be actuated, so that its contacts move between make and brake position or vice versa, in response to a 1/10 mile per hour per second change in acceleration or deceleration. It is also desirable to reduce hysteresis which retards the operation of the switch so that it can reset in response to a change in acceleration or deceleration of 1/10 mile per hour per second. Such high sensitivity and low hysteresis is difficult to accomplish with pendulum based acceleration or deceleration responsive switch mechanisms without unreasonably large pendulum mass. It is desirable to use a pendulum of reasonable size and mass for example 5 pounds and 6 inches or less in length. Inasmuch as such small pendulums develop relatively low force, it has been necessary to utilize special electrical switches which are actuated by low forces. It is desirable, however, to use commercially available switches such as Microswitches which are small in size and low in cost.

It is another object of the invention to provide an improved pendulum based, acceleration and/or deceleration responsive electrical switch mechanism in which overswing of the pendulum in response to acceleration or deceleration is reduced, as is also response to high frequency components of acceleration or deceleration, and in which motion in response to transient events outside the frequency range of the acceleration or deceleration events which are to be detected (e.g., the stopping of a train) are inhibited. The mechanical system including the pendulum will of course have a low resonant frequency and assist in filtering out transient events. It is, however, desirable to rapidly bring the pendulum back to equilibrium position after a swing in response to acceleration or deceleration and without oscillation amplitudes which might reactuate the switch and cause erroneous operation. The provision of damping devices in the space available in the switch mechanism presents a significant design problem when range of environmental conditions is to be accommodated, especially the very low temperatures which a train may encounter. It is therefore a further object of the present invention to provide an improved pendulum based, acceleration and/or deceleration responsive electrical switch mechanism in which damping is effected by means of which occupy a relatively small space in the switch mechanism and which is operable over a wide range of environmental conditions.

Briefly described, a switch mechanism for detecting acceleration or deceleration events in accordance with the invention embodies a pendulum having a mass pivotally movable about an axis. The pendulum defines a lever arm between the center of the gravity thereof and the axis. Another lever arm is defined by a member which rotates with the pendulum. These lever arms afford a mechanical advantage. The force multiplied by the lever is transferred to actuate an electrical switch when the pendulum swings a predetermined distance in response to an acceleration or deceleration event. Preferably another lever pivotal on a second axis and coupled to the first lever is used in the forced transfer to the switch thereby further multiplying the mechanical advantage. Commercially available switches which require reasonable force for their actuation may then be used. The motion of the pendulum is damped as by eddy current damping means operatively associated with the pendulum. A vane of conductive material is movable with the pendulum along a path. A magnetic structure provides magnetic flux transverse to the path, which alternates in direction along the path. This alternating flux direction induces oppositely directed electromotive forces in the conductive material of the vane in response to the velocity of the pendulum. This results in eddy currents which rapidly damps the motion of the pendulum, bringing it to rest in the equilibrium position and limiting oscillations which might otherwise reactuate the switch.

The foregoing and other objects, features and advantages of the invention as well as a presently preferred embodiment thereof, will become more apparent from a reading of the following description in connection with the accompanying drawings in which.

Figure 1:
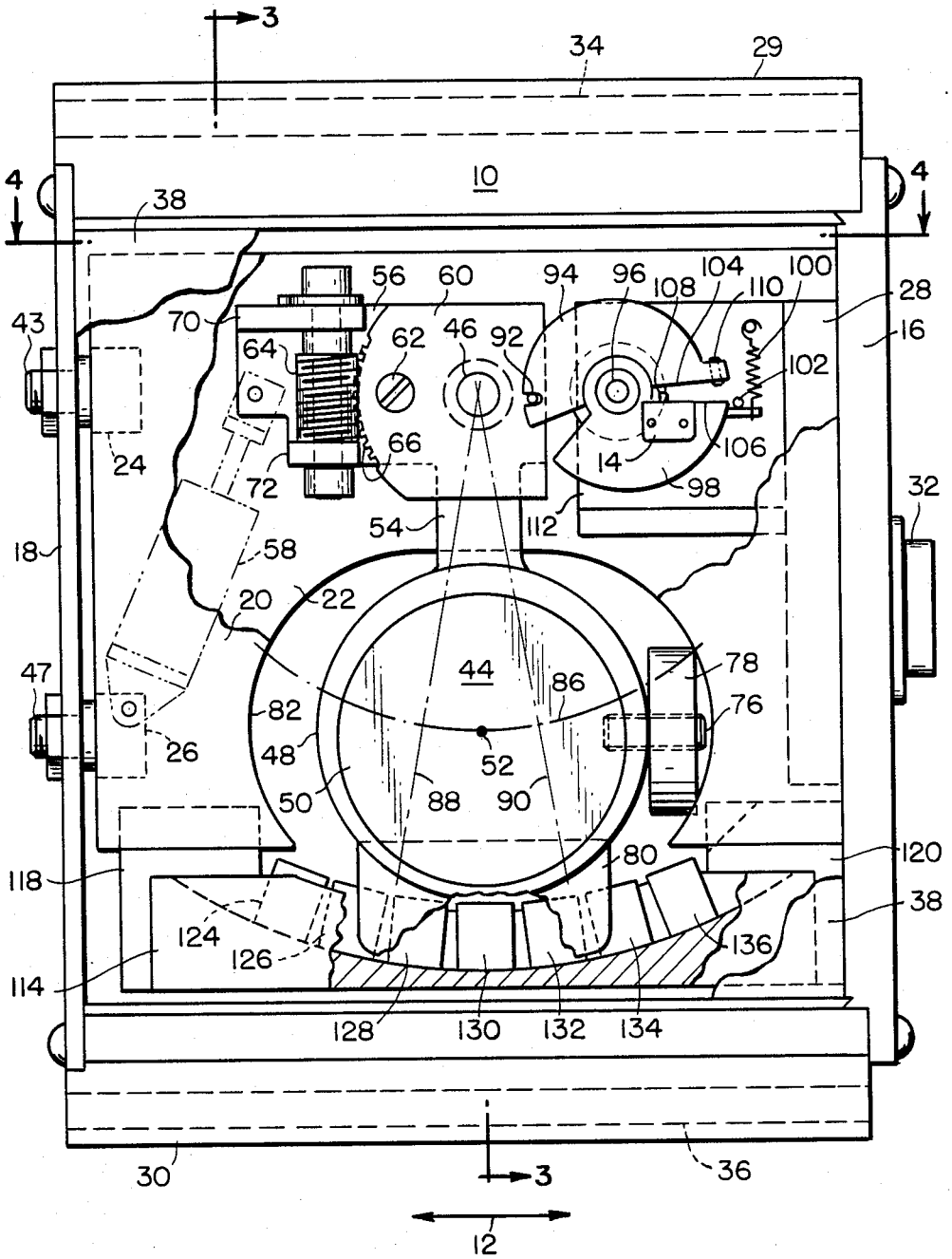
FIG. 1 is a view, in side elevation and partially broken away, illustrating an electrical switch mechanism especially suitable for use in a railway vehicle control system for brake assurances purposes.
Figure 2:
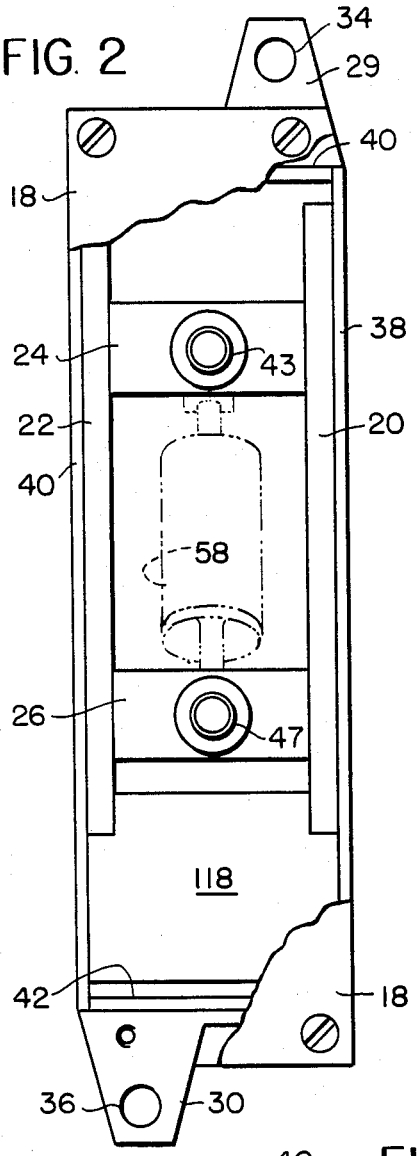
FIG. 2 is an end view taken from the left in FIG. 1, of the mechanism shown in FIG. 1.
Figure 3:
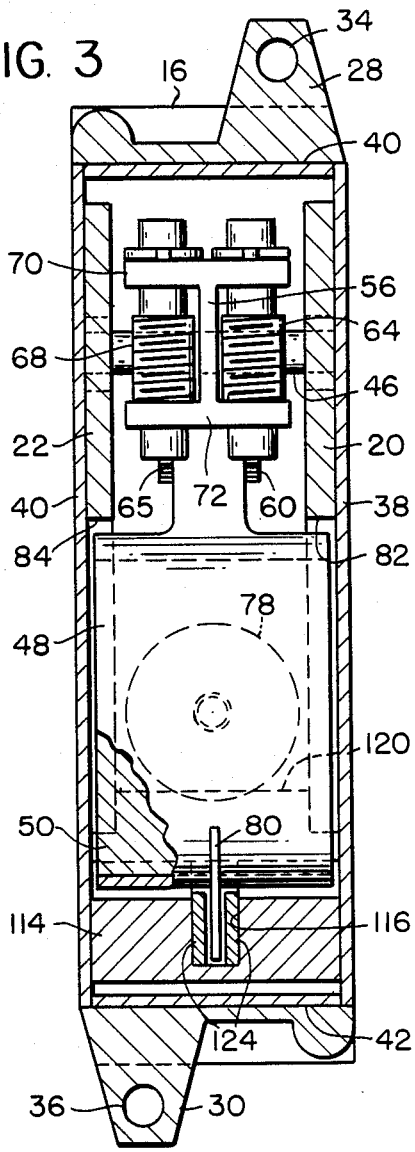
Figure 4:
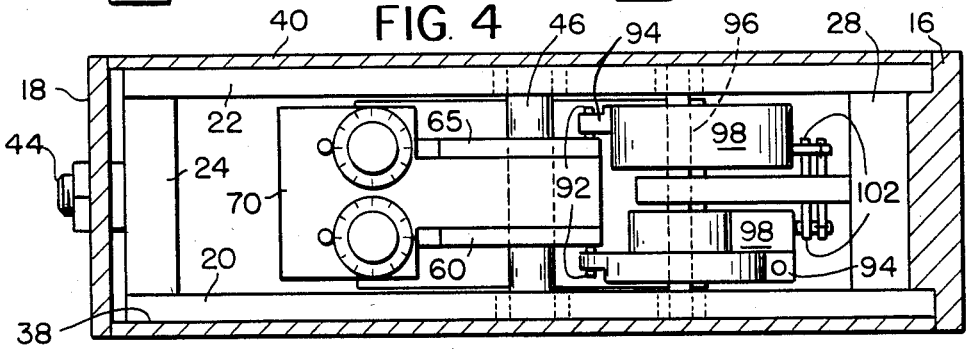

FIG. 3 is a sectional view of the mechanism shown in FIG. 1, the section generally being taken along the line 3—3 in FIG. 1; and FIG. 4 is a sectional view of the mechanism shown in FIGS. 1, 2 and 3 taken from the top and along the line 4—4 in FIG. 3.

Referring more particularly to the drawings, there is shown an electrical switch mechanism 10 which is designed for use in subway train control systems as a brake assurance device. The subway train may be capable of travelling in opposite directions as indicated by the line 12 having arrows at opposite ends thereof in FIG. 1. The mechanism has two switches, one of which 14 is shown in FIG. 1, the other switch is behind the switch 14 and is disposed so that the switches are inverted images of each other. The switches are actuated in response to predetermined deceleration in opposite directions; the switch 14 being actuated in response to a predetermined deceleration as the train is travelling to the right as viewed in FIG. 1. The other switch will be actuated in the response to a predetermined acceleration to the left as viewed in FIG. 1. Of course, the switches may be operated in response to acceleration in one direction and deceleration in the opposite direction. For brake assurance purposes, decelerations in opposite directions are of interest. In a computer control train, the mechanism 10 operates as a device, independent of the computer control system, which checks if the train has slowed down after a command to stop the train has been inputted to the brake controller from the computer. A pre-determined time, say two seconds, after the command to apply the brakes has been inputted, the switch mechanism 10 is interrogated. Assuming that the train is travelling in a direction towards the right as used in FIG. 1, if two seconds after the brake command is inputted, the switch 14 is not actuated to change its state from break to make; the contacts in the switch 14 not being closed, the emergency brake system is activated so as to assure that the brakes are applied and the train comes to a stop.

The mechanism 10 is contained in a case or housing having a front plate 18. A frame is made up of back plate 16, and side plates 20 and 22. Braces 24 and 26 and an adapter plate 28 on the back plate 16 are connected between the side plates 20 and 22. The side plates 20 and 22, the back plate 16 and the braces 24 and 26 constitute the frame of the switch mechanism. Rails 28 and 30 extend between the back plate 16 and the front plate 18. The back plate 16 also has an electrical connector 32 extending rearwardly therefrom. This connector may have prongs which fit into a female connector on the switch panel of the control system in which the switch mechanism 10 is employed. Rods (not shown) extending through bores 34 and 36 in the rails 29 and 30 hold the mechanism in place with the connector 32 inserted in the female connector on the panel of the control system. These rods may extend from the panel of the control system and have threaded ends which project through the bores 34 and 36. Nuts on the ends clamp the mechanism against the panel so as to secure the mechanism 10 in place.

The front plate and side panels 38 and 40 and top and bottom panels 40 and 42, which may be of clear, plastic materials such as polycarbonate, provide the case for the switch mechanism; preventing the introduction of dust and dirt. Bolts 43 and 47, by which the front plate 18 of the case is fastened to the frame at the braces 24 and 26 may be provided with tamper proof seals. These seals, if broken, present evidence of tampering with the mechanism 10 and are useful in assuring the railway personnel that the brake assurance mechanism has not been subject to attempts to defeat its operation.

A pendulum 44 is mounted on an axle 46 journaled in bearings in the side plates 20 and 22. The pendulum 44 is thus pivotally mounted for rotation about the axis of the axle 46. The pendulum has a cylindrical lower section 48 with a bore eccentrically located therein. A cylinder 50 of heavy material, such as lead, concentrates the center of gravity 52 of the pendulum within the cylinder 50. The cylindrical lower section 48 of the pendulum is connected to a stem 54 attached to the axle 46. Preferably integral with the stem 54 and generally perpendicular thereto, is a portion 56 which extends in a direction radially to the axis of the axle 46. This extension 56 provides a mounting for means to adjust the set point of the mechanism so as to enable the switch 14 and the other switch 15 to trip or be actuated in response to predetermined levels of deceleration. The extension 56 also provides a support for a dash-pot damper 58, shown in phantom in FIGS. 1 and 2 which may optionally be used in the switch mechanism 10.

Mounted on the same pivotal axis as the pendulum 44 is a section of a worm gear 60. This worm gear section 60 and another worm gear section 65 on the opposite side of the stem 54 and extension 56 thereto are rotatable about the pivotal axis of the pendulum 44 to selected inclinations to a perpendicular to the axis of rotation of the pendulum through the center of gravity 52 thereof, and locked in place to the extension 56 by set screws 62. The angular position or inclination of the worm gear section 60 sets the deceleration at which the switch 14 is actuated or tripped. The angular orientation of the worm gear section 60 may be adjusted by means of a rotatable worm arrangement 64; the disc 60 having gear teeth 66 along the circular edge thereof. Another worm arrangement 68 for adjusting the angular position of the worm gear section 65 on the opposite side of the worm gear 60 is also provided. These worms are mounted in the extension 56, and particularly in flanges 70 and 72 thereof.

It will be noted that the eccentric bore in which the lead cylinder 50 is disposed provides a thickened section immediately adjacent to stem 54. This thickened section enhances the strength of the pendulum 44. The pendulum 44 including its stem 54 and extension 56 and the disc sections 60 and 65 which are rotatably mounted thereon with the worm arrangements 64 and 68 are all pivotally mounted on the axle 46 and rotate about the same pivotal axis as the pendulum 44. A counterbalance consisting of a threaded pin 76 and a threaded disc 78 may be used to compensate for the weight of the extension 56 and the worm arrangements 64 and 68. The worm arrangements and most of the extension 56 may be eliminated. Then, the disc sections 60 and 65 may be adjusted by hand after loosening the set screw 62 and the set screw which attaches the disc section 65 to the pendulum. The counterbalance pin 76 and disc 78 may then also be dispensed with. A locking rod (not shown) may be inserted through the front plate 18 to prevent the pendulum from oscillating before installation and during shipment.

Also part of the pendulum and depending therefrom is a vane 80 of conductive material, such as copper. This vane is part of an eddy current damper which dissipates the kinetic energy stored in the pendulum 44 and damps the oscillation thereof. The pendulum cylindrical section 48 extends into openings 82 and 84 in the side plates 20 and 22. The use of these openings 80 and 82 enables the pendulum to utilize substantially all of the width of available in the casing for the device 10. The pendulum center of gravity 52 swings along an arc 86, as shown in FIG. 1. The swing is over a segment of the arc 86 indicated between the dot-dash lines 88 and 90. The pendulum itself may be of relatively small size and mass. The mass of the pendulum may for example be approximately 5 pounds.

It is desirable that the pendulum respond to deceleration or acceleration over a range of from 1.5 to 3.5 mph per second and have a sensitivity of at least 0.1 mph per second and a hysteresis not exceeding 0.1 mph per second. These characteristics are accomplished in accordance with the invention through the use of a forced transfer arrangement between the pendulum center of gravity 52 and the switch 14 which provides a mechanical advantage. The hysteresis and sensitivity is also not derogated by reason of the use of the eddy current damper which is provided in accordance with the invention. The mechanical advantage is obtained by a first lever provided by the disc section 60 and the pendulum 44. Between the center of gravity 52 and the pivotal axis (the axis of the axle 46), there is defined a first arm of the lever. This arm may, in a practical embodiment, be 3 inches long. Another arm of the lever is defined between the pivotal axis and a pin 92. The distance between the axis of the pin 92 and the pivotal axis of the pendulum 44 may be ½ inch, in a practical embodiment. The lever thus provides a mechanical advantage of six.

This mechanical advantage is further multiplied by another lever provided by a disc sector 94 which is pivotally mounted on another axis parallel to the pivotal axis of the pendulum 44. An axle 96 fixedly mounted in a divider plate 112. The axle 96 defines the pivotal axis of the sector 94. Bearings in the disc sector 94 rotatably mount it on the axle 96. This disc sector 94 has a notch in which the pin 92 fits so as to provide a pivotal connection between the disc section 60 and the disc sector 94. A disc sector 98 provides a support for the switch 14. The switch 14 is suitably a Microswitch which is attached to a disc sector 98. The disc sector 98 is pivotally mounted on the axle 96 by bearings, and is rotatable independently of the other disc sector 94. A spring 100 biases the switch carrying disc sector 98 against a stop 102.

The disc sectors 94 and 98 have opposed surfaces 104 and 106. These surfaces define a jaw of the switch assembly. The button or actuator pin 108 of the Microswitch 14 projects through the surface 106 and is depressed when the jaw, defined by the surfaces 104 and 106, close. A striker pin 110 on the disc sector 94 projects through the surface 104 with a projection which may be adjusted to set the separation of the jaw when closed.

The disc sector 94 defines a second lever for multiplying the mechanical advantage of the first lever provided by the pendulum 44 and the disc section 60. A first arm of the second lever is defined between the pivotal axis (the axis of the axle 96) and the axis of the pin 92. The second arm of this lever is between the pivotal axis and the point on the surface 104 which is opposed to the actuating button 108 of the switch 14. In a practical example, the first lever arm may be ¾ of an inch and the second arm ⅜ of an inch providing a 2 to 1 mechanical advantage. The total mechanical advantage of the forced transfer mechanism is therefore 12. Accordingly, a relatively small mass, such as the five pound mass of the pendulum 44 is capable of actuating a conventional Microswitch, such as the switch 14 which requires an actuating force of two to three ounces. The mechanical advantage of this force transfer mechanism also enhances the sensitivity of the system to acceleration. In addition, hysteresis is minimized since low friction bearings are used for the pendulum and the disc sectors 94 and 98 and further, since the spring 100 is effectively taken out of the system by the stop 102 when the switch 14 is deactivated or reset.

Consider the operation of the mechanism 10 when the train on which the mechanism is installed has been travelling in a direction towards the right in FIG. 1 and begins to decelerate. The pendulum 44 then swings counter clockwise carrying the disc section 60 and the pin 92 with it. The disc sector 94 then pivots about its axis 96 in a clockwise direction. When the jaw surfaces 104 and 106 come together, the button 108 of the switch 14 is depressed and the switch is activated. Actuation occurs after the pendulum swings a predetermined distance. The distance which the pendulum swings depends upon the level of deceleration. The switch actuation or trip point may be adjusted over the acceleration range of the mechanism (in this example, from 1.5 to 3.5 miles per hour per second) by changing the inclination of the worm gear section 60 with respect to the perpendicular through the pendulum center of gravity 52. As mentioned above, this is accomplished by loosening the set screw 62 and then pivoting the disc section 60 by hand or through the use of the worm gear arrangement 64, if it is provided. For example, if the deceleration level was set to 2.5 miles per hour per second by appropriate adjustment of the angular orientation of the disc section 60, the jaw surfaces 104 and 106 would come together and the switch 14 actuated when the pendulum swings counter clockwise a distance corresponding to a deceleration of 2.5 miles per hour per second. When the acceleration exceeds 2.5 miles per hour per second, the pendulum swings further in the counter clockwise direction. The striker pin 110 then contacts the jaw surface 106 of the disc sector 98 and moves the disc sector 98 against the bias of the spring 100 to provide an over travel of the switch 114 and disc sector 98. Damage to the switch 14 is therefore obviated. When the pendulum swings back towards vertical, the spring 100 brings the sector 98 back returning it to the stop 102 as soon as the deceleration decreases below 2.5 miles per hour per second by 1/10 of a mile per hour per second. The switch 14 resets and is deactivated. The hysteresis due to the restoring spring 100 is isolated by the stop 102. The only spring in the system is the spring in the switch 14 and the only source of hysteresis in the friction in the bearings supporting the axle 46 and mounting the disc sectors 94. The assembly including the other switch which responds to deceleration when the train is moving in the direction towards the left as viewed in FIG. 1 is disposed on the opposite side of the divider 112 which is connected to the adapter plate 28. Both of the switch assemblies are identical. They are, however, inverted with respect to each other so as to enable bidirectional response to deceleration events.

The eddy current damper, as mentioned above includes the vane 80 which swings with the pendulum along a path below the pendulum 44. A magnet structure is provided by a block 114 of soft iron having a slot 116 along the path of the vane 80. This block 114 is attached to the side plates 20 and 22, as by brackets 118 and 120. A plurality of pairs of magnets (7 magnet pairs 124 through 136 in this example) are disposed in the slot 116 on opposite sides of the path of travel of the vane 80. These magnets may be cemented in place as by an epoxy adhesive. They are permanent magnets, preferably of the rare earth type, e.g., summerium cobalt. Adjacent pairs are polarized in opposite directions. Accordingly, the magnets of the pair 124 present opposed poles on opposite sides of the vane 80 which are polarized oppositely to the poles presented by the magnets 126 adjacent thereto. Similarly the magnets 128 are polarized opposite to the magnets 126. The magnetic flux therefore alternates in direction along the path of travel of the vane 80. Electromotive forces in opposite directions are therefore established in the vane resulting in strong eddy currents. As the vane 80 moves along the path, the energy stored in the pendulum is dissipated in these eddy currents losses ($I^2R$) in the vane material, and the pendulum rapidly comes to the equilibrium position with very little overswing. This arrangement results in a system which is essentially critically damped.

As an alternate or additional damping means, the dash-pot 58 may be used. This dash-pot is conveniently located between the side plates 20 and 22. The dash-pot 58 has a cylinder, preferably a pnuematic cylinder in which a piston attached to a plunger can reciprocate. The plunger is pivotally attached to the extension 56 of the pendulum 44. The opposite end of the cylinder from the plunger may also be pivotally attached as in a slot in the brace 26. Accordingly, dash-pot damping may be provided. The eddy current damping is used exclusively in accordance with a preferred embodiment of the invention; the pneumatic dash-pot 58 not being employed.

From the foregoing description it will be apparent that there has been provided an improved electrical switch mechanism which is especially suitable for use as a brake assurance device. Variations and modifications of the herein described embodiment of the invention, within the scope of the invention, will undoubtedly suggest themselves to those skilled in the art. Accordingly the foregoing description should be taken as illustrative and not in a limiting sense.

I claim:

1. A switch mechanism for detecting acceleration or deceleration events which comprises a pendulum having a mass pivotally movable about a first axis and defining a first arm of a first lever between the center of gravity thereof and said first axis, means rotatable about said first axis defining a second arm of said first lever shorter than said first arm to provide a mechanical advantage, an electrical switch, means coupling said switch and second arm in force transfer relationship to enhance the sensitivity of said switch to the acceleration or deceleration of said pendulum mass, and further comprising eddy current damping means operatively associated with said pendulum and including a vane of conductive material movable with said pendulum along a path, and means for providing magnetic flux transverse to said path which alternates in direction along said path.

2. A switch mechanism for detecting acceleration or deceleration events which comprises a pendulum having a mass pivotally movable about a first axis and defining a first arm of a first lever between the center of gravity thereof and said first axis, means rotatable about said first axis defining a second arm of said first lever shorter than said first arm to provide a mechanical advantage, an electrical switch, means coupling said switch and second arm in force transfer relationship to enhance the sensitivity of said switch to the acceleration or deceleration of said pendulum mass, and wherein said coupling means comprises means rotatable about a second axis and defining a second lever having a first arm coupled to said second arm of said first lever and a second arm disposed in actuating relationship with said switch to multiply the mechanical advantage of said first lever, and further comprising means rotatable about said second axis and defining a support for said switch, and means providing for rotation of said support means and said second lever to compensate for overtravel of said second lever beyond the position where actuation of said switch occurs, and wherein said second arm of said first lever is a first member attached to said pendulum and extending radially from said first axis, said second lever is a second member pivotally mounted on said second axis and having portions extending radially in opposite directions toward and away from said first axis to provide said first and second arms of said second lever, means pivotally connecting said first and second members for conjoint rotation, said support means being a third member pivotally mounted on said second axis, said third member extending radially from said second axis in the same direction as the portion of said second member which provides said second arm of said second lever and presenting a surface opposed thereto to define a jaw, said switch having an actuator projecting from said surface of said third member for engagement with the jaw portion of said second member.

3. The invention as set forth in claim 2 wherein said second and third members are first and second discs sectors having opposed edges extending radially in the same direction to provide said jaws and present said surface opposed to said second arm of said second lever, said jaw, closing when said first disc sector is rotated in a direction toward said opposed surface and rotating said second disc sector with said first disc sector upon closure of said jaw, a spring biasing said second disc sector to rotate in a direction opposite to said direction toward said opposed surface, and means for limiting the rotation of said second disc sector in said opposite direction to a position where said opposed surface is separated from said first disc sector unless said pendulum is subjected to greater than a predetermined acceleration or deceleration.

4. The invention as set forth in claim 3 wherein said switch is of the Microswitch type.

5. The invention as set forth in claim 3 wherein said means pivotally connecting said first and second members is a notch in the edge of one of said first and second members and a pin in the other of said first and second members having its axis parallel to said first and second axes and extending into said notch.

6. The invention as set forth in claim 5 wherein said first member has gear teeth along at least a portion of the edge thereof, gear means attached to said pendulum and in meshing relationship with said gear teeth, and means for rotating said gear means for rotating said first member to change the angular orientation of said first member and said first disc section so as to change the level of acceleration or deceleration of said pendulum which actuates said switch.

7. A switch mechanism comprising an electrical switch, a pendulum, means in force translating relationship between said pendulum and switch for actuating said switch in response to a predetermined level of acceleration or deceleration of said pendulum, eddy current damping means operatively associated with said pendulum and including a vane of conductive material movable with said pendulum along a path, and a plurality of magnets spaced along said path, alternate ones of said magnets being polarized in opposite directions.

8. The invention as set forth in claim 7 wherein a plurality of pairs of said magnets are provided, alternate ones of said pairs being polarized in opposite directions.

9. The invention as set forth in claim 7 wherein said pendulum is pivotally mounted for rotation in opposite directions, a magnetic structure having a slot defining said path, said magnets being disposed in said structure along said slot.

10. The invention as set forth in claim 8 wherein said pendulum is pivotally mounted for rotation about an axis adjacent one end thereof, a magnetic structure disposed adjacent the opposite end of said pendulum, said structure having a slot defining said path, said vane being disposed in said slot, said pairs of magnets being disposed in said structure, the magnets of each of said pairs being opposed to each other on opposite sides of said slot.

11. The invention as set forth in claim 10 wherein each of said magnets is a body of permanent magnetic material with opposite poles opposed to each other on opposite sides of said slot, said poles alternating north-south, south-north, north-south . . . along said slot.

* * * * *